US005874884A

United States Patent [19]

Hull et al.

[11] Patent Number: 5,874,884

[45] Date of Patent: Feb. 23, 1999

[54] BLOWN FUSE INDICATOR CIRCUIT INCLUDING A LIGHT HOUSING CONTAINING A LIGHT SOURCE AND METHOD OF USE

[76] Inventors: Harold L. Hull, Sparks, Nev.; Galen J. May, 2245 Cielo Vista Dr., Reno, Nev. 89436; Cathy D. Santa Cruz, 7630 Tholl Rd., Reno, Nev. 89506, trustee of Harold L. Hull, deceased

[21] Appl. No.: 897,478

[22] Filed: Jul. 21, 1997

[51] Int. Cl.[6] ..... H01H 85/30; H01H 85/32; G01R 31/07

[52] U.S. Cl. ..... 337/241; 337/242; 337/265; 337/266; 324/550; 324/507; 116/202

[58] Field of Search ..... 337/241, 242, 337/243, 244, 206, 266, 265, 264, 198, 267; 116/202; 324/550, 507

[56] References Cited

U.S. PATENT DOCUMENTS

| | | | |
|---|---|---|---|
| 3,218,413 | 11/1965 | Koch | 200/115.5 |
| 3,457,535 | 7/1969 | Poehlman | 337/242 |
| 3,794,948 | 2/1974 | Linton et al. | 337/242 |
| 4,056,816 | 11/1977 | Guim | 340/253 A |
| 4,281,322 | 7/1981 | Nasu | 340/638 |
| 4,308,516 | 12/1981 | Shimada et al. | 337/241 |
| 4,499,447 | 2/1985 | Greenberg | 337/266 |
| 4,554,607 | 11/1985 | Mora | 361/104 |
| 4,652,867 | 3/1987 | Masot | 340/638 |
| 4,673,928 | 6/1987 | Guim | 340/465 |
| 4,691,197 | 9/1987 | Damiano et al. | 340/638 |
| 4,857,896 | 8/1989 | Brooks | 340/639 |
| 5,300,913 | 4/1994 | Linton | 337/242 |
| 5,311,139 | 5/1994 | Fogal | 324/550 |
| 5,343,192 | 8/1994 | Yenisey | 340/639 |
| 5,701,118 | 12/1997 | Hull et al. | 340/638 |

*Primary Examiner*—Leo P. Picard
*Assistant Examiner*—Anatoly Vortman

[57] ABSTRACT

Apparatus to illuminate a light source when a fuse has blown and method of use. Apparatus including a circuit having: a power supply source, a switch, a load, a fuse housing containing a fuse and a light housing containing a light source.

5 Claims, 4 Drawing Sheets

BLOWN FUSE INDICATOR CIRCUIT INCLUDING A LIGHT HOUSING CONTAINING A LIGHT SOURCE AND METHOD OF USE

FIELD OF THE INVENTION

This invention relates to blown fuse indicator means but more particularly to a light housing containing a light source therein which when installed in combination within a circuit, the light source will illuminate when a fuse has blown so as to notify the user thereof.

BACKGROUND OF THE INVENTION

It is well known within the field that when a fuse has blown, it can be quite time consuming and difficult to locate the fuse, especially under circumstances during the night, or in the dark where no exterior lighting is provided. This situation is more often encountered such as when one is within a vehicle and the fuse block/box is positioned within the glove box or under the dash. In such a situation it can be extremely difficult and irritating when one is searching for the blown fuse which must be replaced and they simply can't see the fuses and/or the fuses are not easily accessible.

It is therefore contended by the applicants that it would be most advantageous and desirable to provide an efficient, easily installed light housing having a light source therein which when installed in combination within an electrical circuit, will illuminate the light source when a fuse has blown. Thus, would eliminate guess work for the user as well as save time and wasted energy.

The above noted situation has been addressed within the prior art and attempts have been made to resolve the problems associated therewith, but most attempts prove to be much to costly and to complicated for the average user to install, and/or is simply inefficient.

The following are exempliary prior art references relating to blown fuse indicators such as found within the field of the present invention. U.S. Pat. No. 5,311,139 teaches a "FUSE CHECKER FOR TESTING INTEGRITY OF A MINIATURE, PLUG-IN FUSE WHILE THE FUSE IS INSTALLED IN AN ELECTRICAL CIRCUIT". This reference is functional for its intended purpose which is to "test" the condition of a fuse. The test is performed by using a checker which includes a housing from which extends a pair of parallel contact points adapted for engagement with terminal tabs that lie within terminal access openings within a plug-in type fuse housing and in practise, the user must manually insert the checker and apply constant pressure upon the terminal tabs while the test is performed and if a fuse is blown, one of two LED's located on the checker housing will illuminate, and if the fuse is not blown, both LED's on the checker will illuminate. This checker device is not designed to be used and/or installed on a permanent basis and is only usable for performing the above described test. This reference is therefore limited in use and could not be installed on a permanent basis, as can the present invention.

Various types of spring clips have been taught for securing a blown fuse light indicator to a cartridge fuse as indicated by U.S. Pat. Nos. 43,432,789 and 3,457,535. However, these references have addressed only cartridge type fuse holders and in each case additional limiting resistors are required and/or a separate plug is required, and each would not be attachable or functional if used on a plug-in type fuse. It is common knowledge that in many cases, the plug-in type fuse has become the fuse housing of choice, such as found within most fuse boxes used within most modern day vehicles. Therefore, it is contended by the applicants that a need exists for substantially a light housing containing a Light source and circuitry which in combination will allow the light source, such as an LED located within the light housing, to indicate that the fuse within the circuit has blown.

It is to be noted that within our co-pending U.S. application Ser. No. 08/603,544, (by the same inventors) we provide a similar device which is an indicator cap which is removably attachable to a prior art plug-in type fuse, and the cap having an indicator tight for signaling that a fuse has blown so as to notify a user of the blown condition of the fuse. However, this invention is similar in function but does not provide the overall unusual results and does not include an indicator cap which is removably attachable to a plug-in type fuse.

SUMMARY OF THE INVENTION

The present invention is substantially a blown fuse indicator circuit including a light housing containing a light source. In the preferred embodiment, the fuse housing is in the form of a fuse plug having a first and a second exposed terminal tab extending therefrom, with the light housing having a first and a second exposed terminal tab extending from substantially a bottom portion thereof, with each tab being of a shape and size to be insertable into a fuse receptacle, with the light housing having substantially a top portion having thereon first and second terminal tab access openings which are of a shape and size to removably receive and mate with the first and second terminal tabs on the fuse plug, with the light housing, the plug housing and associated circuitry (such as a circuit which is commonly found within most vehicle fuse block/boxes with the circuit being energized by a power source, such as a battery) in combination allowing the light source to illuminate when the fuse has blown.

Referring now to the second embodiment of the present invention wherein we provide a fuse housing in the form of a barrel having a first and a second exposed ferrule on each end thereof, and the light housing is in the form of a cartridge, and when the barrel, the cartridge and associated circuitry are combined, this unique combination successfully accomplishes the desired results as well.

It is therefore a primary object of the present invention to provide a light housing containing a light source, (referring to the preferred embodiment) with the housing being removably attachable to an existing prior art plug-in type fuse housing, while in a second embodiment we provide a light housing containing a light source with the housing being removably attachable to a prior art cartridge type fuse housing, and when the light housing, the fuse housing and appropriate circuitry are combined, said light source will illuminate when a fuse has blown and the light source will not illuminate when the fuse has not blown.

It is another object of the present invention to provide a light source of engineering choice, such as an LED indicator light.

It is another important object of the present invention to provide a light housing which may be produced in a variety of colors which correspond to the various types of colored fuse housings, with the color of each representing and indicating amperage thereof.

Still another object of the present invention is to provide a light housing in combination with appropriate circuitry which causes the unusual results of having a light source be illuminated when the fuse has blown.

Yet another object of the present invention is to provide a method for installing in combination, a light housing and a fuse housing within an electrical circuit.

Other objects and advantages will be seen when taken into consideration with the following drawings and specification.

DETAILED DESCRIPTION OF THE DRAWINGS

Figure 1:
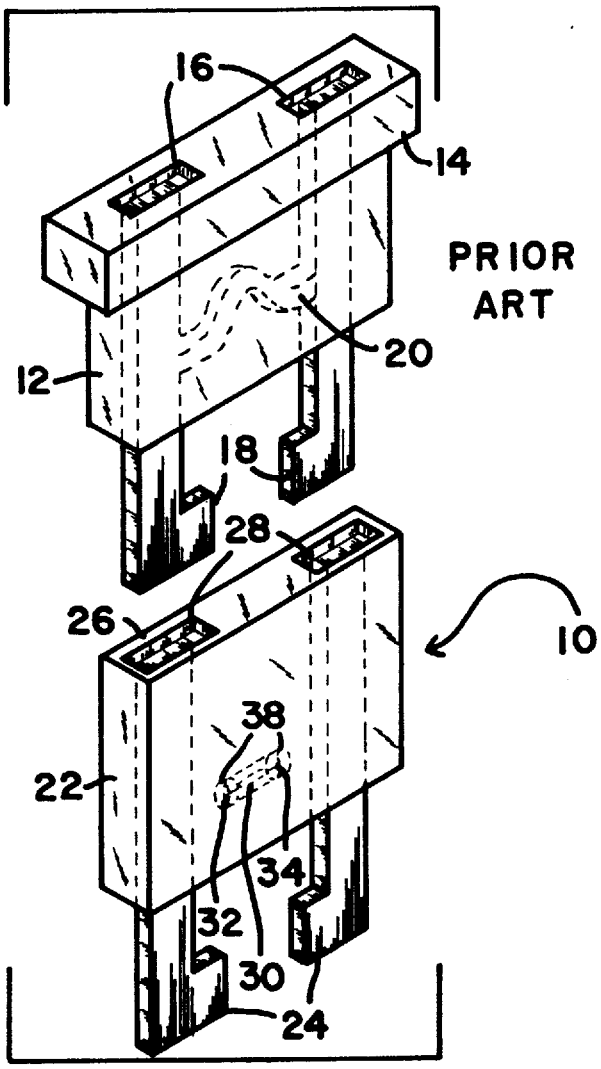
FIG. 1 is substantially a perspective view of a prior art fuse plug and the preferred embodiment for a light housing.

Referring now in detail to the drawings wherein like numerals represent like elements throughout the various views. As illustrated in FIG. 1, (arrow 10) represents an overview of the preferred embodiment for the present invention, with the present invention including use of a typical prior art miniature plug-in type fuse housing (12) containing a fusible link (20) therein, as commonly found within most vehicle electrical circuits. Housing (12) being of colored plastic material, with the color being indicative of the current rating of the fuse so as to signify amperage, and includes a generally rectangular top wall (14) that has a pair of longitudinally spaced terminal access openings (16) that extend through top wall (14) into the interior of fuse housing (12).

Positioned within housing (12) and extending from substantially a bottom portion thereof are first and second parallel, spaced, blade-type fuse terminal tabs (18) which are adapted to be received within a correspondingly spaced pair of fuse receptacle contacts within a plastic fuse block, or the like (not shown). Fuse terminals (18) are of a shape and size to allow for them to extend outwardly from the lower end of housing (12), and also to extend into housing (12) to be received and tightly held by the housing by suitable terminal anchoring arrangements (not shown). Extending between each of fuse terminals (18) within fuse housing (12) is a fusible link (20) which is made from a material that permits the passage between fuse terminals (18) of currents less than the rated current value of the fuse, and that will melt or separate if a current greater than the rated current value of the fuse passes through the fusible link (20).

Figure 2:
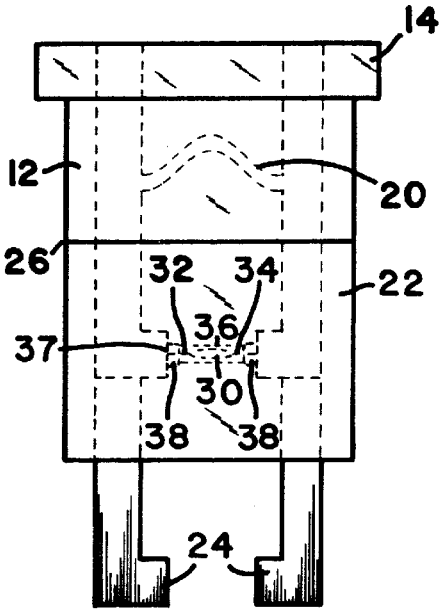
FIG. 2 is substantially a frontal view of FIG. 1 when the prior art fuse plug and the light housing are interconnected and the fuse is not blown.

Referring now to FIGS. 1 & 2 wherein we show the preferred embodiment which includes a light housing (22) which is made from colored plastic material, (or any other suitable material of engineering choice) with the color being indicative of the current rating of the fuse so as to signify amperage. Light housing (22) having a first and a second parallel, spaced, blade-type fuse terminal tabs (24) extending from substantially a bottom portion thereof, which are adapted to be received within a correspondingly spaced pair of fuse receptacle contacts within a plastic fuse block, or the like (not shown). Terminal tabs (24) are of a shape and size to allow for them to extend outwardly from substantially the lower end of housing (22), and also to extend into housing (22) to be received and tightly held by the housing by suitable terminal anchoring arrangements (not shown). Light housing (22) having substantially a top portion (26) having thereon first and second terminal tab access openings (28) which are of a shape and size to removably receive and mate with the first and second terminal tabs (18) of fuse plug (12). Light housing (22) containing a light source (30) which may any suitable light source of engineering choice, such as a light emitting diode, (LED), having first and second connection means, such as a first wire lead (32) and a second wire lead (34). The light housing (22) having a suitable means of engineering choice, such as a cavity (37) to retain the LED (30) and the first and second connection means (32 & 34) therethrough. For example, a light support structure may be provided which is substantially of the same construction as a typical prior art cartridge fuse housing which is constructed from an elongated hollow cylinder (36) which is of any suitable size of engineering choice and which is made from any suitable material of engineering choice, for example glass, or the like, with the cylinder (36) having on each end thereof a contact ferrule (38) for engagement with terminal tabs (18) of fuse plug (12) and the light source (30) and each wire lead (32 & 34) being retained within the cylinder (36) and each wire lead (32 & 34) being fixedly attached to their respective contact ferrule (37 & 38) by any suitable attachment means of choice. It is to be noted that various means of engineering choice to retain the light (30) within the light housing (22) and various means to connect the connection means (32 & 34) may be used, and the above described means is only exemplary of one possible way of accomplishing the desired end result.

It will now be seen throughout views 1, 2 & 3, wherein we show the preferred embodiment for the present invention, that when the typical prior art fuse plug (12) is removed from its respective fuse receptacle (not shown), and the present invention, namely, the terminal tabs (24) of the light housing (22) are installed where the fuse plug (12) was installed, and the terminal tabs (18) of fuse plug (12) are inserted into terminal access openings (28) of light housing (22), each of the terminal tabs (18 & 24), light source (30) and fuse link (20) are in open communication and thus provide unique apparatus and circuitry.

Figure 3:
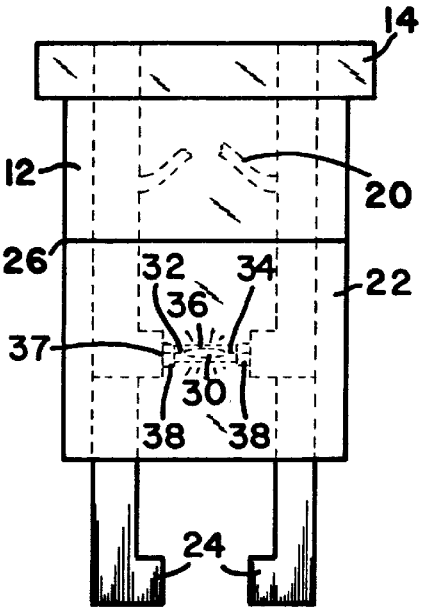
FIG. 3 is substantially a frontal view of FIG. 2 showing a blown fuse and the light housing with a light being illuminated.
Figure 7:
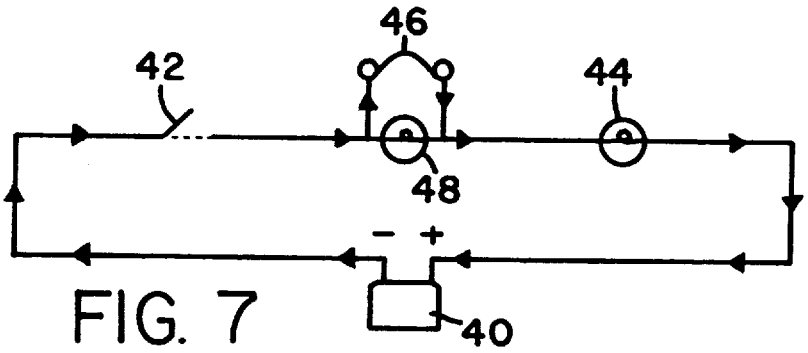

Referring now in detail to FIG. 7, wherein we provide a schematic for the preferred embodiment of FIGS. 1–3, which in combination with a power supply source (40), (such as a battery), a switch (42) which has an open and a closed position, (such as a vehicle light switch), a load (44), (such as the light to be lit), a light source (48), (such as the LED 30) and a fuse (46) will provide most unusual results, namely, when the circuit is energized, (thus completing the circuit) and the fuse (46) is not blown, the light source (48) will, not illuminate, and when the fuse (46) is blown, the light source (48) will illuminate.

Figure 8:
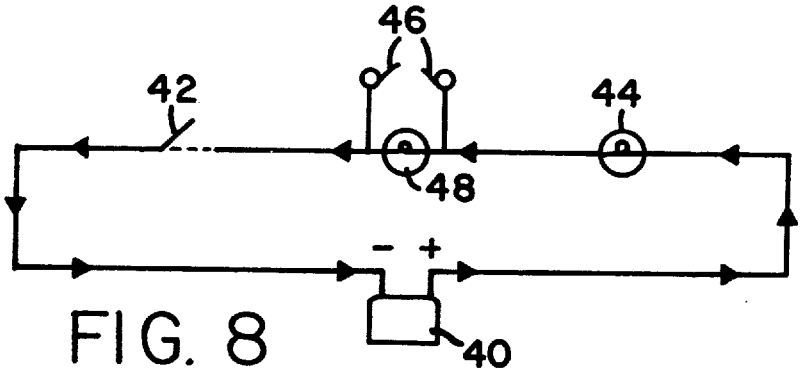

It will now be seen that when the power source (40) energizes the circuit, the current will flow in the direction of the arrows as depicted within FIG. 7, which directs the current toward switch (42), and when switch (42) is activated into its closed position (depicted by ghost fines), the current is then directed to fuse (46) (thus bypassing the light source 48) which in turn energizes load (44) (depicted as a light) and the circuit is thus completed and therefore light source (48) will not be illuminated. However, when the fuse (46) blows, (as depicted in FIG. 8) and the power source (40) energizes the circuit, the current will flow in the direction of the arrows through the load (44), through the light source (48) which is now illuminated, through the switch (42) which is in a closed position and thus completes the circuit.

Figure 6:
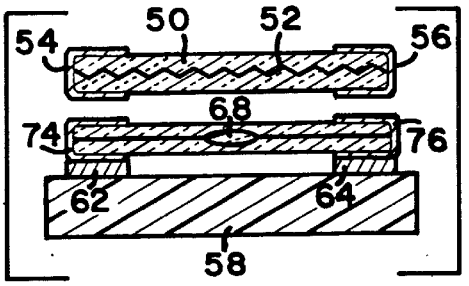
FIG. 6 is substantially a sectional view taken at 6—6 of FIG. 4.

It is to be noted that the direction of current flow as illustrated by arrows within FIGS. 6 & 7, is only for exemplary purposes, as it is understood by the applicants that the invention works even if the flow of current is directed in either direction.

Figure 4:
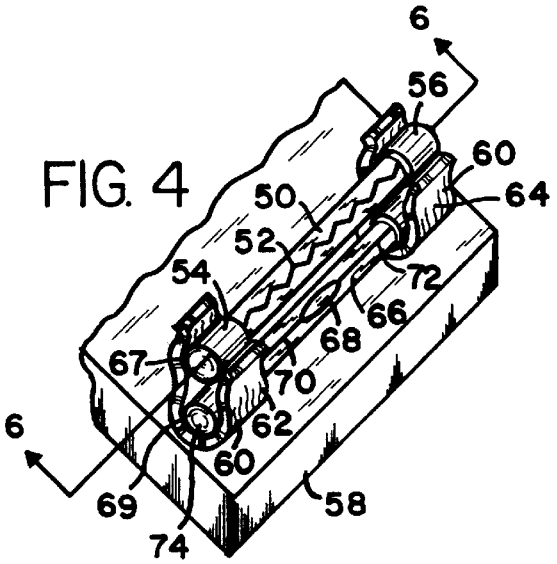
FIG. 4 is substantially a perspective view of a second embodiment for the present invention.
Figure 5:
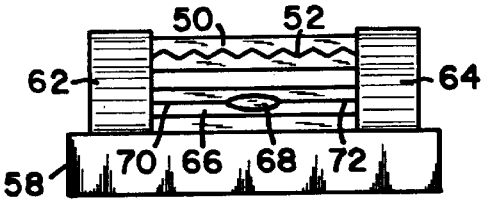
FIG. 5 is substantially a frontal view of FIG. 4.

Referring now to the second embodiment depicted in FIGS. 4, 5 and 6, wherein we provide a different apparatus for use with a different type of fuse receptacle which accomplishes the same unusual results. As shown throughout the noted views, (50) is a typical prior art barrel shaped fuse housing containing a fuse link (52), which is made from a material that permits the passage of currents less than the rated current value of the fuse, and that will melt or separate if a current greater than the rated current value of the fuse passes through the fusible link (52). Fuse housing (50) having a first and a second exposed ferrule (54 & 56) on each end thereof. Referring now to FIG. 4 wherein we partially show a typical prior art fuse block (58) having at least one typical prior art fuse receptacle (60) thereon, with the receptacle comprising a first and a second gripping member (62 & 64) each of which are so formed as to provide a first space (67) which is of a size and shape to frictionally receive therein fuse housing (50) and a second space (69) which is of a size and shape to frictionally receive a light housing (66), whereby, fuse receptacle (60) is of a shape and size to removably support the fuse barrel (50) and the cartridge shaped light housing (66) simultaneously thereon, and each gripping member (62 & 64) are fixedly attached to the fuse block (58) in an aligned manner so that when a typical prior art fuse housing (50) is frictionally inserted into the first space (67), each of the gripping members (62 & 64) support the fuse housing (50) in a secure manner and allow for each of the gripping members (62 & 64), the fuse housing (50) and the fuse block (58) to be in communication.

Referring now to the present invention which in the second embodiment is a light housing (66) which is formed into the shape of a cartridge, (which is made from any suitable material of engineering choice) with the light housing (66) containing a light source (68), (which may be any suitable light source of engineering choice, for example, an LED), with the light source (68) having means to communicate with each of the gripping members (62 & 64). For example, the light source (68) is an LED having a first and a second wire lead (70 & 72) therefrom, each of which are fixedly attached to a first and a second ferrule (74 & 76) which are located on each end of fuse housing (50).

It will now be seen that when the fuse block (58) is installed in a circuit, (such as the previously described circuit) and the user removes the pre-existing fuse housing (50) from within space (67) of receptacle (60), then inserts light housing (66) into space (69), and then re-installs the pre-existing fuse housing (50) into space (67), thus completing installation, and when the fuse link (52) is not blown and the circuit is energized, the light source (68) will not illuminate, and when the fuse link (52) is blown, the light (68) source will illuminate, therefore accomplishing most unusual results heretofore not seen nor taught.

It is to be noted that if so desired, the fuse housing (50) and the light housing (66) may be integrally formed at the point of manufacture.

It will now be seen that we have herein provided unique circuitry and apparatus which will illuminate a light source when a fuse has blown, thus, notifying the user that the fuse must be changed.

It will also be seen that we have herein provided two embodiments for the invention so as to allow the light housing to be installed within a fuse-plug receptacle or a fuse-block receptacle of choice.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and or apparatuses.

Having described our invention, what we claim as new and desire to secure by Letters Patent is:

1. A circuit comprising in combination: a power supply source; a switch; a load; a fuse housing containing a fuse; and a light housing containing a light source; said fuse housing being a fuse plug having a first and a second exposed terminal tab extending therefrom, said light housing having a first and a second exposed terminal tab extending therefrom, each said tab being of a shape and size to be inserted into a fuse receptacle, and said light housing having thereon first and second terminal tab access openings which are of a shape and size to removably receive and mate with said first and said second terminal tab of said fuse plug, said light source is a light emitting diode having a first and a second wire lead extending therefrom, each said first terminal tab and said first wire lead being in communication, and each said second terminal tab and said second wire lead being in communication, whereby;

when said circuit is energized, thus completing said circuit, and said fuse is not blown, said light source will not illuminate, and when said fuse is blown, said light source will illuminate.

2. The circuit of claim 1 includes said light housing having at least one cavity therein for retaining said first and said second wire lead there through.

3. The circuit of claim 1 wherein said fuse plug and said light housing are each color coded so as to signify amperage.

4. A method for installing a light housing containing a light source within a circuit, said circuit comprising: a power supply source, a switch, a load and a fuse housing containing a fuse therein with the fuse housing being installed within a fuse receptacle, said method including the following steps of;

a. removing said fuse housing from said receptacle;

b. inserting said light housing into said receptacle;

c. inserting said fuse housing into said light housing; and d. energizing said circuit, Whereby;

when said fuse is not blown, said light source will not illuminate, and when said fuse is blown, said light source will illuminate.

5. A method for installing a light housing containing a light source within a circuit, said circuit comprising: a power supply source, a switch, a load and a fuse housing containing a fuse therein with the fuse housing being installed within a fuse receptacle, said method including the following steps of;

a. removing said fuse housing from said receptacle;

b. inserting said light housing into said receptacle;

c. inserting said fuse housing into said receptacle; and d. energizing said circuit, Whereby;

when said fuse is not blown, said light source will not illuminate, and when said fuse is blown, said light source will illuminate.

* * * * *